US006674031B1

(12) United States Patent
Flegel

(10) Patent No.: US 6,674,031 B1
(45) Date of Patent: Jan. 6, 2004

(54) POWER INLET BOX WITH INTEGRAL CIRCUIT BREAKER

(75) Inventor: David D. Flegel, Racine, WI (US)

(73) Assignee: Reliance Controls Corporation, Racine, WI (US)

( * ) Notice: Subject to any disclaimer, the term of this patent is extended or adjusted under 35 U.S.C. 154(b) by 103 days.

(21) Appl. No.: 09/921,053

(22) Filed: Aug. 2, 2001

(51) Int. Cl.[7] ..... H01H 9/02

(52) U.S. Cl. ..... 200/297; 200/51 R; 174/53; 361/643

(58) Field of Search ..... 174/53, 54, 58; 200/50.28, 50.29, 50.3, 50.31, 51.12, 51 R, 297, 296; 361/643, 622, 673; 439/535

(56) References Cited

U.S. PATENT DOCUMENTS 1,938,309 A * 12/1933 Williams ..... 200/51 R
2,908,743 A * 10/1959 Premoshis ..... 174/53
3,286,051 A * 11/1966 Mackiewicz ..... 200/50.29
3,585,456 A * 6/1971 Phillips, Jr. ..... 361/663
3,812,281 A * 5/1974 Boyer ..... 174/53
4,058,358 A * 11/1977 Carlisle ..... 439/142
5,984,719 A 11/1999 Flegel ..... 439/528
6,062,914 A * 5/2000 Fasano ..... 361/673 X
6,448,515 B1 * 9/2002 Rohmer et al. ..... 200/50.28

* cited by examiner

*Primary Examiner*—Renee Luebke
(74) *Attorney, Agent, or Firm*—Andrus, Sceales, Starke & Sawall, LLP

(57) ABSTRACT

A power inlet box adapted to connect an auxiliary power generator to an electrical system of a building includes a housing adapted for mounting to the building and having a base member defining an internal cavity, and a cover member removably interconnected with the base member for enclosing the internal cavity. A power inlet is mounted to the housing within the internal cavity, and a switching mechanism is supported in the housing within the internal cavity and is adapted to be electrically connected to the power inlet. A mounting assembly is secured to the housing within the internal cavity for supporting the switching mechanism in a fastener free arrangement such that, upon removal of the cover member from the base member, the switching mechanism is quickly installed by manually engaging the switching mechanism with the mounting assembly.

6 Claims, 4 Drawing Sheets

POWER INLET BOX WITH INTEGRAL CIRCUIT BREAKER

FIELD OF THE INVENTION

This invention relates broadly to a power inlet box used in providing power to an electrical system of a building in the event of a power outage or the like, and more particularly, pertains to a power inlet box equipped with a uniquely support circuit breaker.

BACKGROUND OF THE INVENTION

In an auxiliary power supply system, a remote power generator is interconnected with a power inlet box which is typically mounted to the exterior of a building. The power inlet box is, in turn, interconnected with a manual transfer switching arrangement, which is connected to the main electrical panel or load center of the building. A cord is interconnected with the power outlet of the generator and with a power inlet receptacle associated with the power inlet box for providing power from the generator through the power inlet box to the manual transfer panel, and ultimately to the main electrical panel in order to supply power to certain circuits of the building in the event of a power outage or the like.

Prior art power inlet boxes are comprised of a base member defining an internal cavity, and a cover member or assembly adapted for removable interconnection with the base member for enclosing the internal cavity. The power inlet is mounted to the cover assembly and includes a mounting member positionable within an opening formed in the cover assembly, and a power receptacle socket structure to which is attached various electrical wiring from the building. An access cover is associated with the mounting cover and is pivotable between a closed position in which the access cover covers the mounting member to prevent access to the power receptacle socket structure, and an open position providing access to the power receptacle socket structure. The details of the construction set forth above are more fully described in the assignee's U.S. Pat. No. 5,984,719, issued Nov. 16, 1999, which is herein incorporated by reference.

Other prior art power inlet boxes having a base member and a cover assembly are known wherein a power inlet is mounted to a bottom wall of the cover assembly such that the inlet is openly accessible from beneath the power inlet box. In addition, the power inlet box is provided with a circuit breaker which is directly wired to the power inlet and further enables control of the power between the generator and the main electrical panel. That is, the circuit breaker limits the maximum amount of amperage being delivered into the building to protect downstream circuits. In prior art power inlet boxes of this type, the circuit breaker is removably attached to a front wall of the cover assembly by four separate screws such that the movable switches of the circuit breaker protrude through an opening formed in the cover assembly front wall. The front wall of the cover assembly is, in turn, attached by two screws to mounting ears on the base member. Access to the movable switches of the fastened circuit breaker is normally prevented by a protective shield or face plate which is fastened to a threaded boss projecting forwardly from the cover assembly.

In order to service the circuit breaker inside the power inlet box described above, it is necessary to first remove the screw that holds the shield or face plate over the cover assembly. Then, after removing the two screws from the mounting ears and separating the cover assembly from the base member, the four screws in the cover assembly front wall must be removed to release the circuit breaker through the opening in the cover assembly. Even then, to completely remove and inspect the circuit breaker, the wiring from the power inlet must be detached from the circuit breaker terminals by loosening two other screws. If the shield or face plate is left off, both the power inlet on the bottom of the cover assembly and the circuit breaker on the front wall of the cover assembly are fully exposed to the elements which could cause further maintenance problems.

There remains a continued need for a differently-styled power inlet box provided with a circuit breaker which is more easily physically and electrically connected within the housing defined by the base member and the cover assembly. There is likewise a further need to protect the power inlet and circuit breaker in the power inlet box from exposure to moisture and other elements.

SUMMARY OF THE INVENTION

It is one object of the present invention to provide a power inlet box with a circuit breaker for limiting the maximum amount of power being delivered to the circuits of a main electrical panel.

It is also an object of the present invention to provide a power inlet box having a fastener free, mounting assembly for supporting the circuit breaker in the housing of the power inlet box.

It is a further object of the present invention to provide a power inlet box for supporting a circuit breaker in a friction fit arrangement such that the arrangement places the circuit breaker in electrical communication with a power inlet in the box.

It is an additional object of the present invention to provide a power inlet box having a circuit breaker which is mounted either on a rear wall of a base member or a front wall of a cover member.

Yet another object of the present invention is to provide access cover structure for selectively providing and preventing access to a power inlet and a circuit breaker mounted in a power inlet box.

In one aspect of the invention, a power inlet box adapted to connect an auxiliary power generator to an electrical supply of a building includes a housing adapted for mounting to the building and having a base member defining an internal cavity, and a cover member removably interconnected with the base member for enclosing the internal cavity. A power inlet is mounted to the housing within the internal cavity, and a switch mechanism is supported in the housing within the internal cavity and adapted to be electrically connected to the power inlet. A mounting assembly is secured to the housing within the internal cavity for supporting the switching mechanism in a fastener free arrangement such that, upon removal of the cover member from the base member, the switching mechanism is quickly installed by manually engaging the switching mechanism with the mounting assembly. The switching mechanism includes a spring biased terminal structure which is engagable in a friction fit with stab structure on the mounting assembly. The switching mechanism further includes notch structure which is engagable with hook structure on the mounting assembly. The power inlet includes wiring connected to the stab structure on the mounting assembly such that attachment of the switching mechanism to the mounting assembly enables electrical communication between the power inlet and the switching mechanism. The mounting assembly includes bracket structure attached to either a rear wall of the base member or a front wall of the cover member. The mounting assembly supports the switching mechanism along a rear wall and a bottom wall thereof.

In another aspect of the invention, a power inlet box is adapted to connect an auxiliary power generator to an electrical system of a building. The power inlet box includes a housing adapted for mounting to the building and having a base member defining an internal cavity, and a cover member removably interconnected with the base member for enclosing the internal cavity. A power inlet is mounted to the housing and extends through a hole formed in the housing such that the power inlet is accessible externally of the housing. A switching mechanism is supported in the housing within the internal cavity and projects through an opening in the housing such that the switching mechanism is accessible externally of the housing. A mounting assembly is secured to the housing within the internal cavity and is electrically connected to the power inlet for supporting the switching mechanism in a friction fit arrangement such that friction fit attachment of the switching mechanism to the mounting assembly places the switching mechanism in electrical communication with the power inlet. A first access cover is disposed over the hole in the housing for selectively providing and preventing access to a socket structure in the power inlet, and a second access cover is disposed over the opening in the housing for selectively providing and preventing access to movable switches of the switching mechanism.

The invention also contemplates a power inlet box having a housing including a base member defining an internal cavity, and a cover member removably connected to the base member for enclosing the internal cavity, a power inlet mounted to the housing within the internal cavity, and a switching mechanism supported in the housing within the internal cavity, the power inlet and switching mechanism being accessible externally of the housing. The invention is improved by a mounting assembly secured to the housing within the internal cavity and electrically connected to the power inlet for supporting the switching mechanism in a friction fit arrangement. The mounting assembly is defined by an insulated base plate having stab structure frictionally and electrically engagable with the switching mechanism for supporting the switching mechanism along one portion thereof. A retainer plate has foot structure for supporting the switching mechanism along another portion thereof. A support bracket has attachment structure for attaching the support bracket to either the base member or the cover member. The base plate, the retainer plate, and the support bracket are removably interconnected together. The stab structure on the base plate is comprised of a pair of conductive lugs for retaining wiring attached to the power inlet. The foot structure of the retainer plate includes at least one upwardly extending projection engagable with notch structure formed in the switching mechanism. The support bracket has a generally U-shaped member defined by a bight portion and a pair of spaced apart leg portions, each of the leg portions being provided with the attachment structure in the form of a laterally extending attachment portion. In the preferred embodiment, the retainer plate is interposed between the base plate and the support bracket. The attachment portions are connected to a rear wall of the base member, a rear surface of the retainer plate is juxtaposed to an external surface of the bight portion and a rear surface of the base plate is juxtaposed to a front surface of the retainer plate. In an alternative embodiment, the support bracket is interposed between the base plate and the retainer plate. The attachment portions are connected to a front wall of the cover member, a front surface of the retainer plate is placed against an external surface of the bight portion and a rear surface of the base plate is placed against an internal surface of the bight portion.

In yet another aspect of the invention, a power inlet box includes a base member having a bottom wall, a rear wall and a pair of side walls defining an internal cavity. A cover member has a top wall and a front wall removably fastened to the base member for enclosing the internal cavity. A power inlet is mounted to the bottom wall of the base member and extends through a hole formed therein such that the power inlet is accessible externally of the housing. A circuit breaker is supported within the housing and projects through an opening formed in the front wall of the cover member such that the circuit breaker is accessible externally of the housing. A mounting assembly is secured within the internal cavity to either the rear wall of the base member or the front wall of the cover member and is electrically connected to the power inlet for supporting the circuit breaker in a friction fit arrangement such that friction fit attachment of the circuit breaker to the mounting assembly places the circuit breaker in electrical communication with the power inlet. Access cover structure is associated with the bottom wall of the base member and the front wall of the cover member for selectively preventing and providing access to the power inlet and the circuit breaker.

Various other features; objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

At the outset of this description, it should be appreciated that, although not shown, the present invention is used for interconnecting a remote power generator with the main electrical distribution panel and manual transfer panel of the building via appropriate wiring, as set forth in assignee's U.S. Pat. No. 5,984,719.

Figure 1:
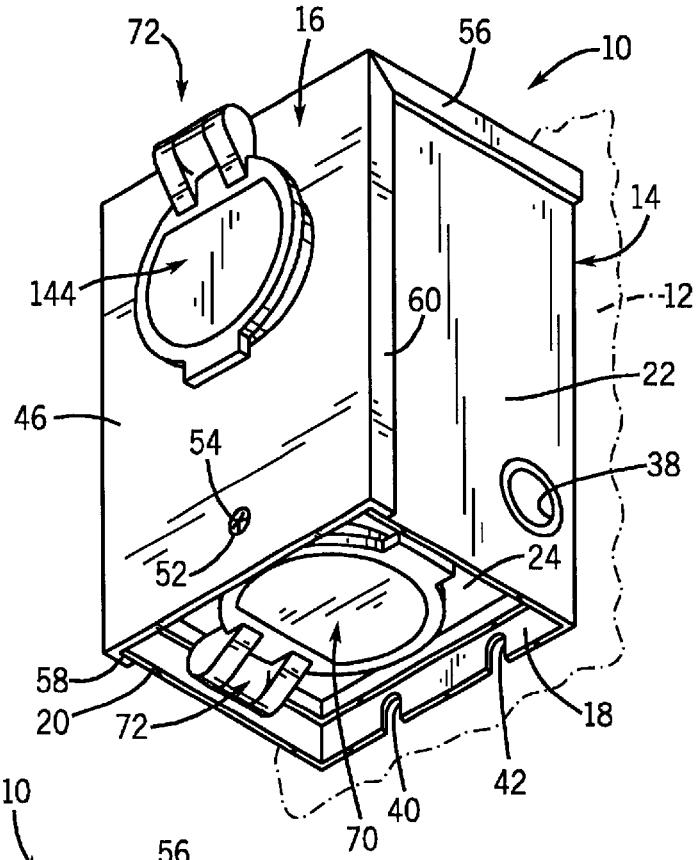
FIG. 1 is an isometric view showing a power inlet box embodying the present invention.
Figure 2:
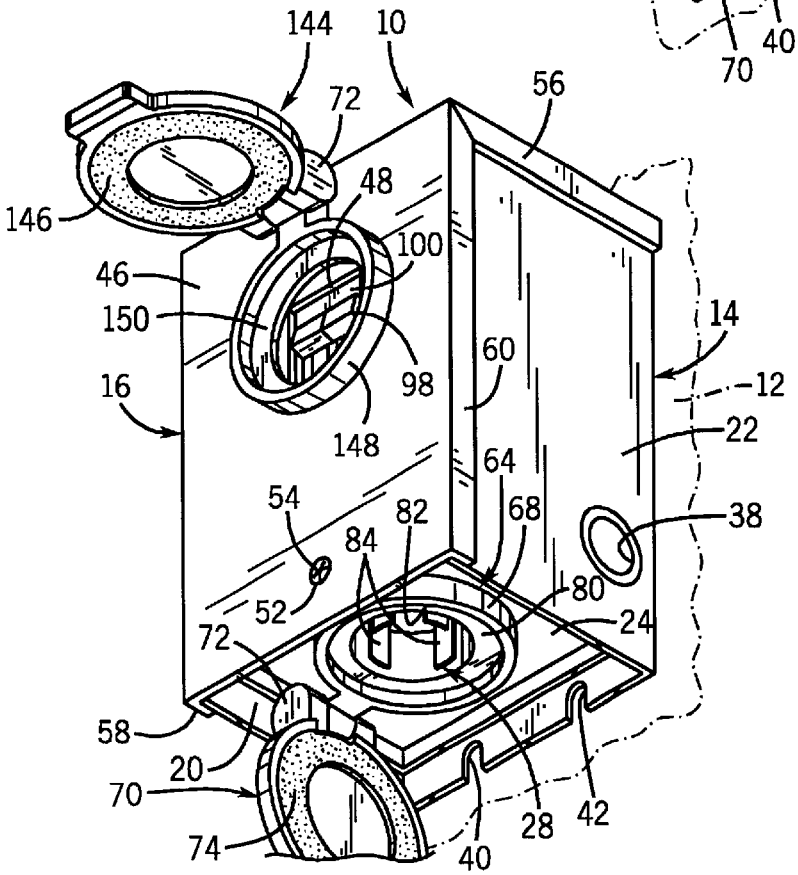
FIG. 2 is an isometric view of the power inlet box of FIG. 1 showing access covers opened to provide access to a power inlet and a circuit breaker mounted in the box.
Figure 4:
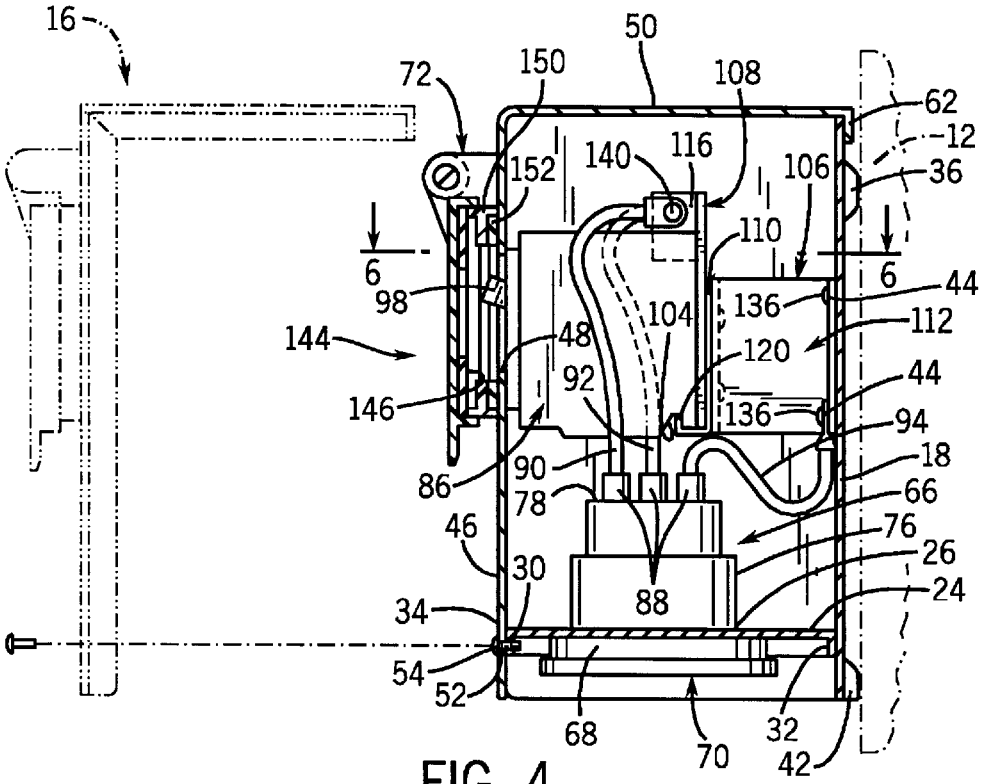
FIG. 4 is a sectional view taken through the power inlet box of FIG. 1 showing the manner in which the cover member is removed in phantom lines.

Referring now to the drawings, and in particular FIGS. 1, 2 and 4, there is shown a power inlet box 10 embodying the invention mounted to the exterior of a building wall 12. Power inlet box 10 generally includes a housing having a base member 14 and a cover member 16 removably attached thereto. Base member 14 includes a rear wall 18 and a pair of sidewalls 20, 22 extending forwardly from the sides of rear wall 18. A bottom wall 24 having a central hole 26 extends forwardly from the lower end of rear wall 18, and extends between the lower ends of side walls 20, 22. A power inlet in the form of a power receptacle socket assembly shown generally at 28 is mounted to bottom wall 24 and extends through hole 26 so that it is accessible externally of the housing. Bottom wall 24 defines a front flange 30 and a rear flange 32, both of which depend downwardly short of the bottom of side walls 20, 22. An opening 34 is formed in the center of front flange 30 to aid in the joining of base member 14 to the cover member 16.

A pair of openings (one being seen at 36) is formed in an upper portion of rear wall 18 for use in mounting base member 14 to wall 12. Side walls 20, 22 include knock-out sections (one being seen at 38) for routing wiring into and out of the housing. Similarly, rear wall 18 and bottom wall 24 include knock-out sections (not shown) in a manner as is known. A pair of fastener receiving slots 40, 42 extend vertically upwardly from the lower edge of rear wall 18 to further facilitate mounting of the base member 14 to the wall 12. In addition, a series of threaded holes 44 are formed in rear wall 18 between the mounting openings 36 and the slots 40, 42.

Cover member 16 includes a front wall 46 having a rectangular opening 48, and a top wall 50 extending rearwardly from the upper end of front wall 46. An aperture 52 is provided in the lower portion of front wall 46 and a threaded fastener, such as a screw 54, is passed through the aperture 52 into threaded engagement with the opening 34 in front flange 30 of base member bottom wall 24. A pair of side flanges, one of which is shown at 56, extend rearwardly from the side edges of front wall 46 throughout the height of front wall 46. Similarly, a pair of flanges 58, 60 extend downwardly from the side edges of top wall 50 throughout the length of top wall 50. A flange 62 (FIG. 4) extends downwardly from the rear edge of top wall 50 between the side flanges 56.

Socket assembly 28 includes a socket base 64 joined to the bottom wall 24 and a socket member 66. Socket base 64 includes a central ring defined by a peripheral upstanding wall 68 surrounding the central hole 26 in bottom wall 24 of base member 14. A first access cover 70 is interconnected with socket base 64 via a hinge mounting arrangement 72, such as the type disclosed in assignee's copending U.S. patent application Ser. No. 09/794,806 filed Feb. 27, 2001. A sealing gasket 74 is mounted to the inside of the access cover 70. In a manner well known, the access cover 70 is pivotable via hinge arrangement 72 between an open position shown in FIG. 2 and a closed position shown in FIG. 1 in which the cover engages the outer edge of peripheral wall 68 such that the access cover 70 overlies the area enclosed by wall 68. Hinge arrangement 72 includes a pivot pin defining the pivot axis of the cover, and a torsion spring for biasing cover 70 towards its closed position.

While the preferred embodiment includes the socket base 64 and the first access cover 70, it should be understood that these two components could be excluded if desired.

Socket member 66 includes a cylindrically stepped side wall 76 terminating in an inner end wall 78. A flange 80 (FIG. 2) extends outwardly from the outer end of side wall 76. A receptacle block 82 having a series of outwardly projecting prongs 84 adapted to be connected to the generator is mounted to the interior of socket member 66. Receptacle block 82 includes terminals adapted to receive and electrically engage a series of wires for conducting power via the prongs 84 to a switching mechanism in the form of a circuit breaker 86 to be further described. A group of tubular wire receivers 88 is included in the top of the socket member 66 to guide and stabilize the ends of the wires connected to the terminals. Socket member 66 as described above is a commercially available component such as manufactured by Marinco, Inc. of Napa, Calif. under their Product No. 3014FI. The wires include at least two power conducting wires 90, 92 and a ground wire 94 attached to the rear wall 18 of the base member 14 by a screw 136.

Figure 5:
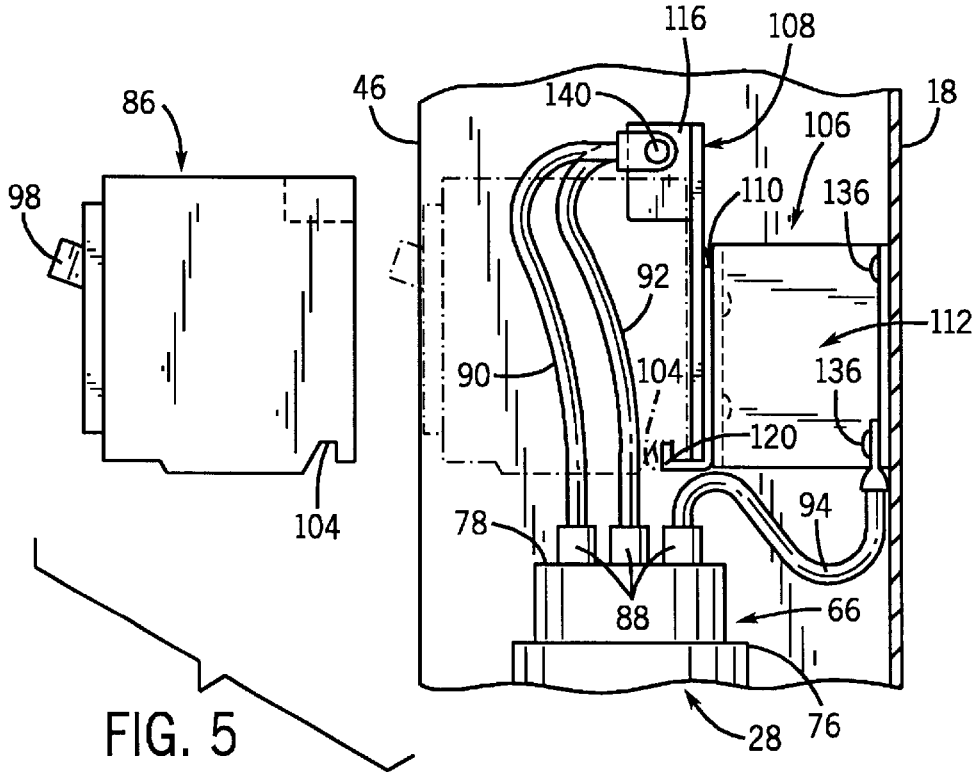
FIG. 5 is a partial view similar to FIG. 4 showing the circuit breaker removed in solid lines and installed in phantom lines.

As seen in FIGS. 4 and 5, circuit breaker 86 is removably supported in the power inlet box housing within the internal cavity and is adapted to be electrically connected to the power inlet 28 and the downstream circuits of the main electrical distribution panel and the transfer panel. In the preferred embodiment, the circuit breaker 86 is typically a type QP, double pole device having a 30 ampere capacity such as manufactured by Siemens Energy Automation, Inc. of Alpharetta, Ga. A front portion of the circuit breaker 86 carries a pair of movable switches 98 connected for positioning between on and off positions by a tie bar 100. At the upper rear portion of the circuit breaker 86 is a spring biased terminal structure in the form of two pairs of curved terminal blades 102 seen best in FIGS. 6 and 7 for helping support the back portion of the circuit breaker 86, but mainly for establishing an electrical connection as will be described further below. The rear bottom portion of the circuit breaker 86 is provided with upwardly extending notch structure 104 for facilitating lower support of the circuit breaker 86. Although not shown, the bottom of the circuit breaker 86 also carries screw terminals for attaching wiring routed into the power inlet box 10 from the downstream panels.

In accordance with the invention, a mounting assembly 106 is secured to the housing within the internal cavity for supporting the circuit breaker 86 in a fastener free, friction fit connection such that, upon removal of the cover member 16 from the base member 14, the circuit breaker 86 is quickly installed by manually engaging the circuit breaker 86 with the mounting assembly 106. As will be understood, the mounting assembly 106 enables the circuit breaker 86 to be coupled for quick connection to the rear wall 18 of the base member 14. It will be further understood that the attachment of the circuit breaker 86 to the mounting assembly 106 enables the circuit breaker 86 to be placed in electrical communication with the power inlet 28.

Figure 3:
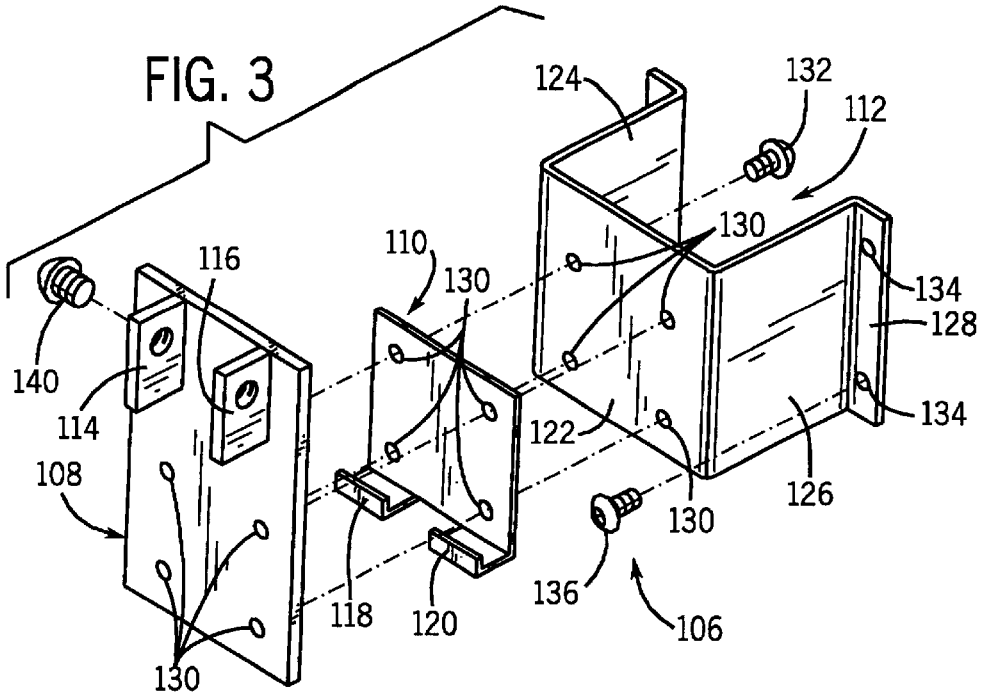
FIG. 3 is an exploded, isometric view of a preferred mounting assembly for supporting the circuit breaker from the rear wall of the power inlet base member.

Turning now to FIG. 3, the preferred form of the mounting assembly 106 is a three-piece bracket structure comprising an insulated base plate 108, a retainer plate 110 and a support bracket 112, all three components being connected together as a unit. Base plate 108 is formed of a generally planar, insulated material having stab structure in the form of a pair of apertured, conductive lugs 114, 116 for retaining wiring attached to the power inlet 28. Retainer plate 110 has a generally, planar metallic surface having foot structure for supporting a bottom, rear portion of the circuit breaker 86. The foot structure preferably has a pair of upwardly extending projections 118, 120 engagable with the notch structure 104 in the circuit breaker 86. Support bracket 112 is a generally U-shaped metallic member defined by a bight portion 122 and a pair of spaced apart leg portions 124, 126. Each of the leg portions 124, 126 is provided with attachment structure defined by a laterally extending attachment portion 128.

The base plate 108, retainer plate 110 and the support bracket 112 are all formed with aligned threaded openings 130 for threadedly receiving screws 132 so as to hold the mounting assembly 106 together. While screws 132 are shown to interconnect the mounting assembly 106, it should be understood that other fastening structure may be used, or the three components may be integrally formed together. The laterally extending attachment portions 128 are each formed with suitable openings 134 for receiving screws 136 that are threadedly received in the holes 44 formed in the base member rear wall 18.

Figure 6:
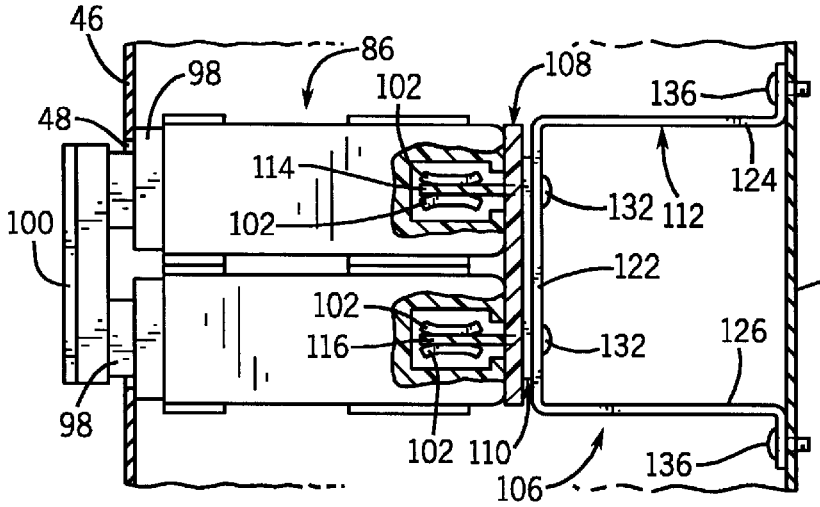
FIG. 6 is an enlarged, partial sectional view taken on line 6—6 of FIG. 4 showing the circuit breaker installed.
Figure 7:
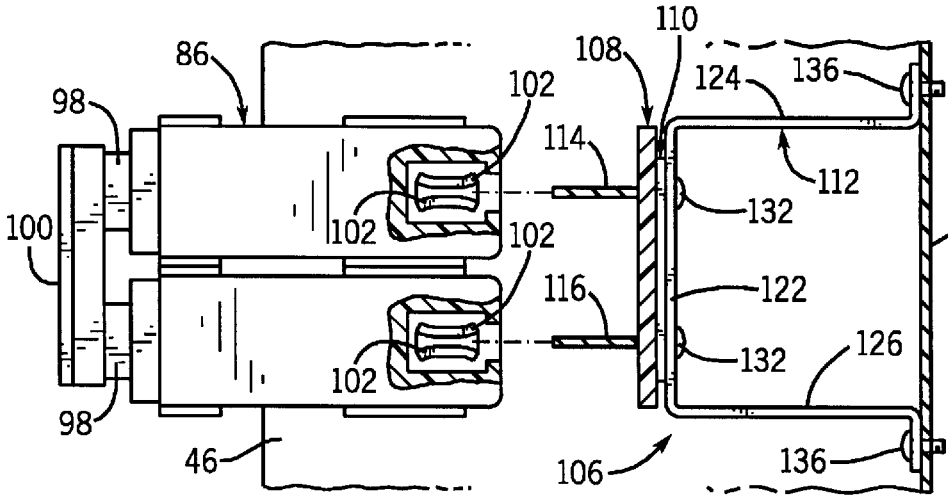
FIG. 7 is a view similar to FIG. 6 showing the circuit breaker removed.

In use, the mounting assembly 106 is joined together such that the retainer plate 110 is interposed between the base plate 108 and the support bracket 112. That is, a rear surface of the base plate 108 is juxtaposed to a front surface of the retainer plate 110, a rear surface of the retainer plate 110 is disposed against an external surface of the bight portion 122 of support bracket 112 and the attachment portions 128 of the support bracket 112 are connected by screws 136 to rear wall 18 of base member 14. At this point, the two power wires 90, 92 from the power inlet 28 are connected to the conductive lugs 114, 116 on the base plate 108 such as by screws 140. Preassembly of the base plate 108, the retainer plate 110 and the support bracket 112, along with connection of the wires 90, 92 is preferably done in the factory. Wiring brought into the power inlet box 10 can then be further connected to terminals at the bottom of the circuit breaker 86. Then, circuit breaker 86 is easily manipulated to engage the notch structure 104 on the bottom thereof with the foot structure 118, 120 on the retainer plate 110, and to push the lugs 114, 116 on the base plate 108 into a fastener free, friction fit with the spring biased terminal blades 102 on the circuit breaker 86 as shown in FIG. 6. Once this two point connection has been quickly established, the circuit breaker 86 is both physically supported in the housing and electrically connected to the power inlet 28. If it is desired to remove the circuit breaker 86, one removes the wiring connected to the terminals at the bottom of the circuit breaker 86, and simply applies a pulling force to easily separate the circuit breaker 86 from the mounting assembly 106 as depicted in FIG. 7. With the circuit breaker 86 installed, the cover member 16 is attached to the base member 14 using the single screw 52.

With the circuit breaker 86 installed as set forth above, the movable switches 98 of the circuit breaker 86 protrude through the square opening 48 in the front wall 46 of the cover member 16 so that they can be accessed externally of the housing. To selectively provide and prevent access to the circuit breaker switches 98, a second access cover 144, like first access cover 70, is pivotally mounted by biased hinge arrangement 72 to a peripheral upstanding wall 148 (FIG. 2). As seen in FIGS. 2 and 4, the access cover 144 includes a sealing gasket 146 on the inside surface thereof, and the peripheral upstanding wall 148 has an annular flange 150 attached to front wall 46. A secondary sealing gasket 152 is placed between the flange 150 and the external surface of the front wall 46 of cover member 16 around the opening 48 through which the circuit breakers 98 protrude. The access cover 144 is normally moved between a closed position shown in FIG. 4 and an open position shown in FIG. 2.

Figure 8:
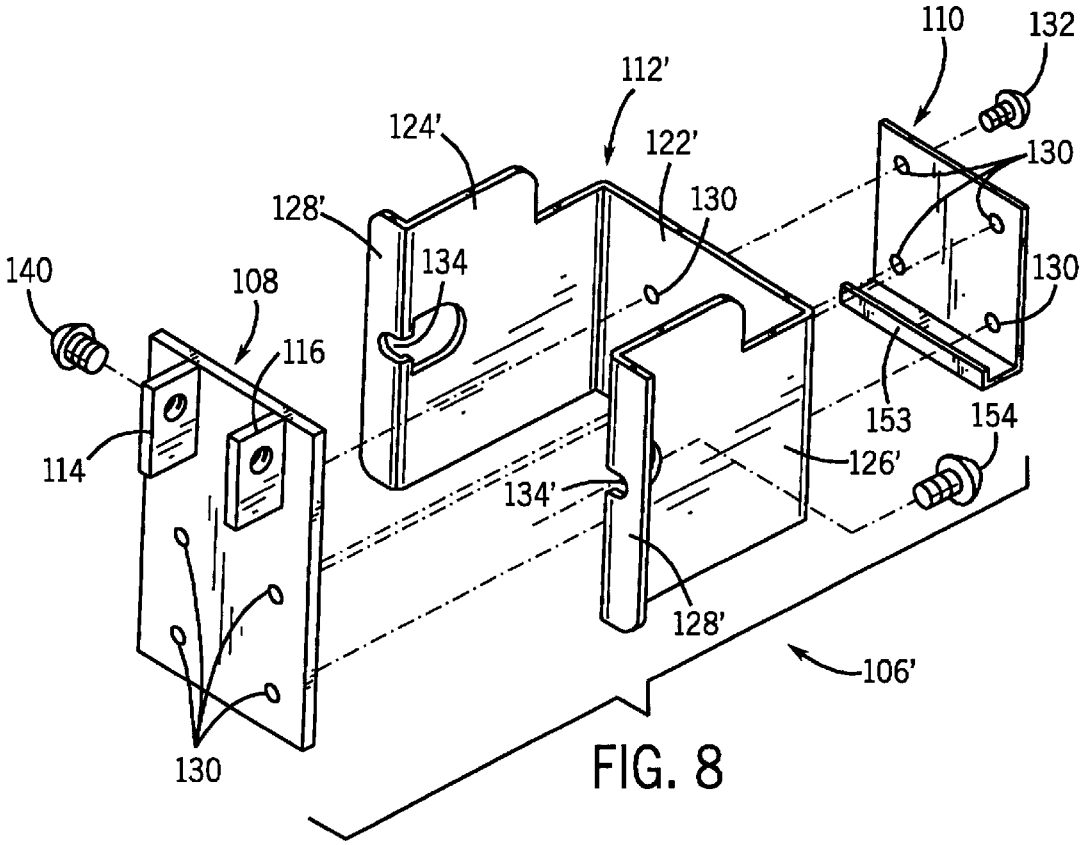
FIG. 8 is an exploded, isometric view of an alternative mounting assembly for supporting the circuit breaker from the front wall of the power inlet cover member.
Figure 9:
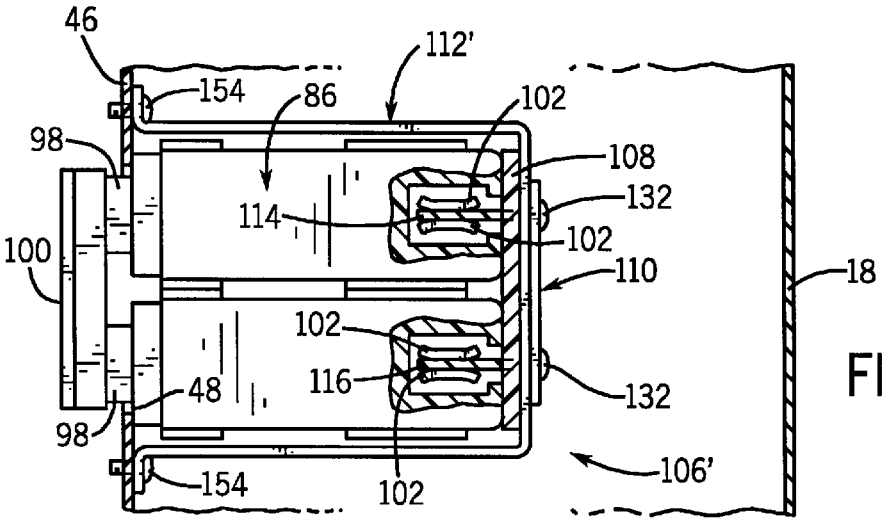
FIG. 9 is a view similar to FIG. 6 showing the circuit breaker installed with the alternative mounting assembly.

FIGS. 8 and 9 show an alternative mounting assembly 106' for supporting the circuit breaker 86 in the housing from the front wall 46 of the cover member 16. In this version, the mounting assembly 106' employs the base plate 108 and the retainer plate 110 described above except that the retainer plate 110 may have only a single projection 153 for its foot structure. Mounting assembly 106' also uses a slightly differently shaped U-shaped support bracket 112' whose position is reversed relative to support bracket 112. The mounting assembly 106' is designed such that the support bracket 112' is interposed between the base plate 108 and the retainer plate 110. More particularly, the rear surface of the base plate 108 is placed against an internal surface of the bight portion 122', a front surface of the retainer plate 110 is placed against an external surface of the bight portion 122' and the attachment portions 128' of the support bracket 112' are joined to the front wall 46 of the cover member 16 by screws 154 through openings 134'. In this modification, the circuit breaker 86 is installed in the mounting assembly 106' following the procedure above before the mounting assembly is attached to the cover member 16.

It should now be fully appreciated that the present invention provides an economical and versatile arrangement in a power inlet box 10 having a circuit breaker feature for safely limiting the amount of power being transferred between a generator and the main electrical and transfer panels in a building. The circuit breaker is conveniently mounted in the power inlet box by means of a fastener free, friction fit attachment which enables both physical and electrical connection and makes servicing of the power inlet box markedly easier. The mounting assemblies 106, 106' of the invention allow the user to rear or front mount the circuit breaker 86 as is desired. To provide for greater safety, access cover structure 70, 144 is offered for both the power inlet 28 and the circuit breaker 86 to prevent intrusion of moisture and other contaminants yet quickly allows access to either component.

Various alternatives and embodiments are contemplated as being within the scope of the following claims particularly pointing out and distinctly claiming the subject matter regarded as the invention.

I claim:

1. In an electrical enclosure having a housing including a base member defining an internal cavity and a cover member removably interconnected to the base member for enclosing the internal cavity, a power inlet mounted to the housing within the internal cavity, and a switching mechanism supported in the housing within the internal cavity, the improvement comprising:

a mounting assembly secured to the housing within the internal cavity and electrically connected to the power inlet for supporting the switching mechanism in a friction fit arrangement wherein the mounting assembly is defined by an insulated base plate having stab structure frictionally and electrically engageable with the switching mechanism for supporting the switching mechanism along one portion thereof;

a retainer plate having foot structure for supporting the switching mechanism along another portion thereof; and a support bracket having attachment structure for attaching the support bracket to either the base member or the cover member, the base plate, the retainer plate and the support bracket being interconnected together, wherein the foot structure of the retainer plate includes at least one upwardly extending projection engageable with notch structure formed on the switching mechanism, wherein the support bracket is a generally U-shaped member defined by a bight portion and a pair of spaced apart leg portions, each of the leg portions being provided with the attachment structure in the form of a laterally extending attachment portion, and wherein the attachment structure is connected to a rear wall of the base member, a rear surface of the retainer plate is juxtaposed to an external surface of the bight portion and a rear surface of the base plate is juxtaposed to a front surface of the retainer plate.

2. The improvement of claim 1, wherein the stab structure on the base plate is comprised of a pair of conductive lugs for retaining wiring attached to the power inlet.

3. In an electrical enclosure having a housing including a base member defining an internal cavity and a cover member removably interconnected to the base member for enclosing the internal cavity, a power inlet mounted to the housing within the internal cavity, and a switching mechanism supported in the housing within the internal cavity, the improvement comprising:

a mounting assembly secured to the housing within the internal cavity and electrically connected to the power inlet for supporting the switching mechanism in a friction fit arrangement wherein the mounting assembly is defined by an insulated base plate having stab structure frictionally and electrically engageable with the switching mechanism for supporting the switching mechanism along one portion thereof;

a retainer plate having foot structure for supporting the switching mechanism along another portion thereof; and a support bracket having attachment structure for attaching the support bracket to either the base member or the cover member, the base plate, the retainer plate and the support bracket being interconnected together, wherein the foot structure of the retainer plate includes at least one upwardly extending projection engageable with notch structure formed on the switching mechanism, wherein the support bracket is a generally U-shaped member defined by a bight portion and a pair of spaced apart leg portions, each of the leg portions being provided with the attachment structure in the form of a laterally extending attachment portion, and wherein the attachment structure is connected to a front wall of the cover member, a front surface of the retainer plate is placed against an external surface of the bight portion, and a rear surface of the base plate is placed against an internal surface of the bight portion.

4. The improvement of claim 3, wherein the stab structure on the base plate is comprised of a pair of conductive lugs for retaining wiring attached to the power inlet.

5. In an electrical enclosure having a housing including a base member defining an internal cavity and a cover member removably interconnected to the base member for enclosing the internal cavity, and a switching mechanism supported in the housing within the internal cavity, the improvement comprising:

a mounting assembly secured to the housing within the internal cavity for supporting the switching mechanism in a friction fit arrangement wherein the mounting assembly is defined by an insulated base plate having stab structure frictionally and electrically engageable with the switching mechanism for supporting the switching mechanism along one portion thereof;

a retainer plate having foot structure for supporting the switching mechanism along another portion thereof; and a support bracket having attachment structure for attaching the support bracket to either the base member or the cover member, the base plate, the retainer plate and the support bracket being interconnected together, wherein the foot structure of the retainer plate includes at least one upwardly extending projection engageable with notch structure formed on the switching mechanism, wherein the support bracket is a generally U-shaped member defined by a bight portion and a pair of spaced apart leg portions, each of the leg portions being provided with the attachment structure in the form of a laterally extending attachment portion, and wherein the attachment structure is connected to a rear wall of the base member, a rear surface of the retainer plate is juxtaposed to an external surface of the bight portion and a rear surface of the base plate is juxtaposed to a front surface of the retainer plate.

6. In an electrical enclosure having a housing including a base member defining an internal cavity and a cover member removably interconnected to the base member for enclosing the internal cavity, and a switching mechanism supported in the housing within the internal cavity, the improvement comprising:

a mounting assembly secured to the housing within the internal cavity for supporting the switching mechanism in a friction fit arrangement wherein the mounting assembly is defined by an insulated base plate having stab structure frictionally and electrically engageable with the switching mechanism for supporting the switching mechanism along one portion thereof;

a retainer plate having foot structure for supporting the switching mechanism along another portion thereof; and a support bracket having attachment structure for attaching the support bracket to either the base member or the cover member, the base plate, the retainer plate and the support bracket being interconnected together, wherein the foot structure of the retainer plate includes at least one upwardly extending projection engageable with notch structure formed on the switching mechanism, wherein the support bracket is a generally U-shaped member defined by a bight portion and a pair of spaced apart leg portions, each of the leg portions being provided with the attachment structure in the form of a laterally extending attachment portion, and wherein the attachment structure is connected to a front wall of the cover member, a front surface of the retainer plate is placed against an external surface of the bight portion, and a rear surface of the base plate is placed against an internal surface of the bight portion.

* * * * *